US005372420A

United States Patent [19]

Van Deursen et al.

[11] Patent Number: 5,372,420

[45] Date of Patent: Dec. 13, 1994

[54] DEVICE HAVING ROTATABLE HEAD

[75] Inventors: Gary Van Deursen, Upper Saddle River, N.J.; Tony Tam; Daniel Kwok, both of Kowloon, Hong Kong

[73] Assignee: Black & Decker Inc., Newark, Del.

[21] Appl. No.: 29,502

[22] Filed: Mar. 11, 1993

[51] Int. Cl.[5] ..... B01F 13/00; B25F 5/02

[52] U.S. Cl. ..... 366/129; 81/57.26; 81/177.9; 173/170; 173/217; 241/285.2; 310/50; 403/102; 403/104; 403/106

[58] Field of Search ..... 366/129, 130, 197, 199, 366/206, 241, 342–344, 349; 173/216, 217, 170; 310/50, 68 A; 241/169.1, 285.2; 403/102, 104, 106, 83, 84, 325, 327; 81/54, 57.11, 57.13, 57.26, 177.1, 177.7, 177.8, 177.9

[56] References Cited

U.S. PATENT DOCUMENTS

| | | | |
|---|---|---|---|
| 2,483,727 | 10/1949 | Frisbie . | |
| 3,773,094 | 11/1973 | Kuenzel | 81/177.8 X |
| 3,868,742 | 3/1975 | Brenner | 15/172 |
| 4,347,450 | 8/1982 | Colligan | 310/50 |
| 4,522,270 | 6/1985 | Kishi | 173/170 X |
| 4,645,352 | 2/1987 | Valbona . | |
| 4,759,240 | 7/1988 | Lin | 81/177.8 |
| 4,912,349 | 3/1990 | Chang | 310/50 |
| 4,976,173 | 12/1990 | Yang | 81/177.8 X |
| 5,199,335 | 4/1993 | Arnold et al. | 81/177.7 X |

FOREIGN PATENT DOCUMENTS

| | | | |
|---|---|---|---|
| 1429176 | 10/1968 | Germany | 366/129 |
| 2172609 | 7/1990 | Japan | 173/170 |

*Primary Examiner*—David A. Scherbel
*Assistant Examiner*—Charles Cooley
*Attorney, Agent, or Firm*—Barry Deutsch

[57] ABSTRACT

A device comprising a housing including first and second housing members. The first housing member is selectively rotatable relative to the second housing member between first and second operating positions. The longitudinal axis of the first housing member is disposed at a substantially 90° angle relative to the longitudinal axis of the first housing member when in the first operating position. The longitudinal axis of the first housing member is disposed substantially coaxial with the longitudinal axis of the second housing member when in the second operating position. An actuator includes a locking arm selectively engagable with the first housing member for retaining the member in a selected operating position when in engagement therewith.

9 Claims, 2 Drawing Sheets

FIG. 4
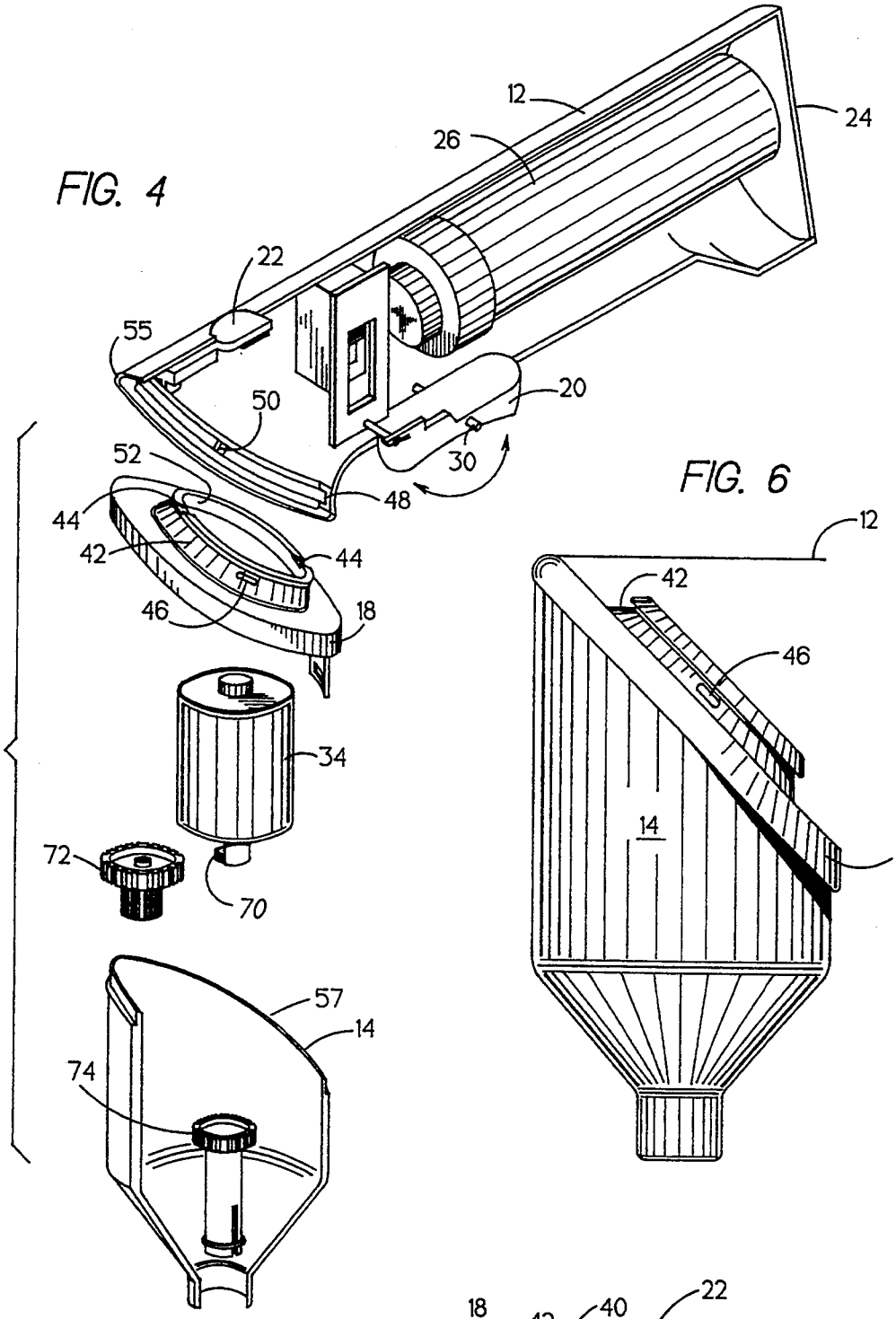
FIG. 6
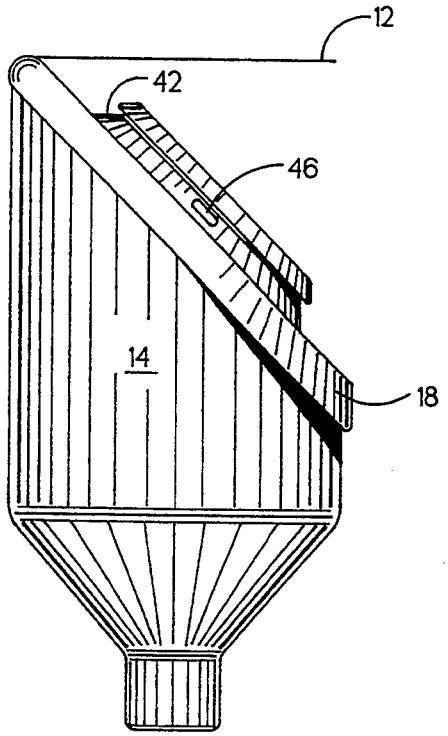
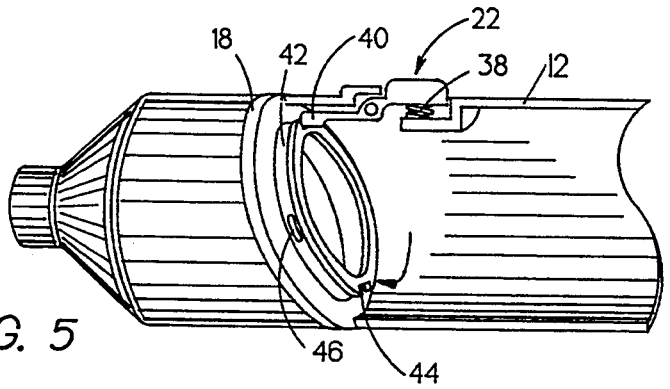
FIG. 5

DEVICE HAVING ROTATABLE HEAD

BACKGROUND OF THE INVENTION

This invention relates to small appliances and specifically relates to a hand-held appliance capable of operating both as a mixer or as a blender.

Hand-held mixers and hand-held blenders are known in the prior art. Generally, the mixer has a head that is disposed at a generally 90° angle relative to a handle. The blender generally has a head having a longitudinal axis disposed colinear with the longitudinal axis of the handle.

Blenders and mixers each have their own particular uses. Blenders are typically used in mixing drinks whereas mixers are used in combining solid ingredients such as flour and the like.

The ownership and use of hand-held mixers and blenders have grown in popularity in the recent years. It has been found that many consumers would like to own both hand-held mixers and blenders, but not very many have both products.

Accordingly, it is an object of the present invention to provide a single hand-held device that has the ability to function as either a mixer or a blender.

SUMMARY OF THE INVENTION

The foregoing object and other objects of the invention are attained in a device comprising a housing having first and second housing members. The first housing member is selectively rotatable relative to the second housing member between first and second operating positions. The longitudinal axis of the first housing member is disposed at a substantially 90° angle relative to the longitudinal axis of the second housing member when in the first operating position and is disposed substantially colinear with the longitudinal axis of the second housing member when in the second operating position. A switch including a locking arm is selectively engagable with the first housing member for retaining the member in the selected operating position when in engagement therewith.

BRIEF DESCRIPTION OF THE DRAWING

FIG. 4 is an exploded perspective view illustrating major components of the device;

FIG. 5 is a somewhat perspective view of a portion of the device illustrating details thereof; and FIG. 6 is a side elevational view of one the housing members of the device illustrating specific details of the present invention.

DETAILED DESCRIPTION OF THE PREFERRED EMBODIMENT

Figure 1:
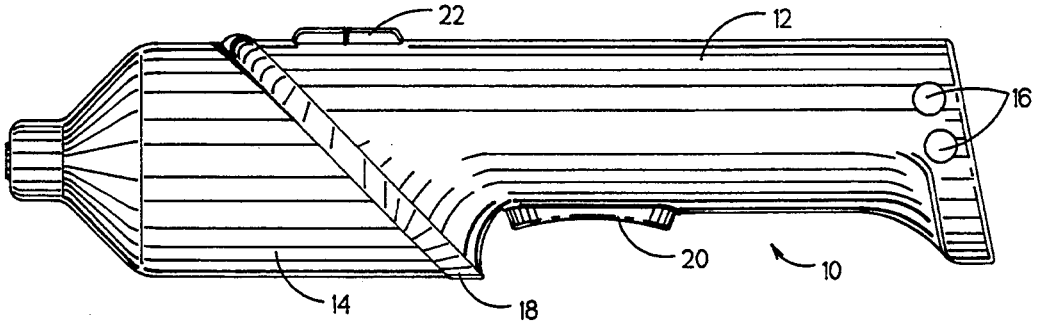
FIG. 1 is a side elevational view of the device of the present invention illustrating the head thereof in a first operating position.
Figure 2:
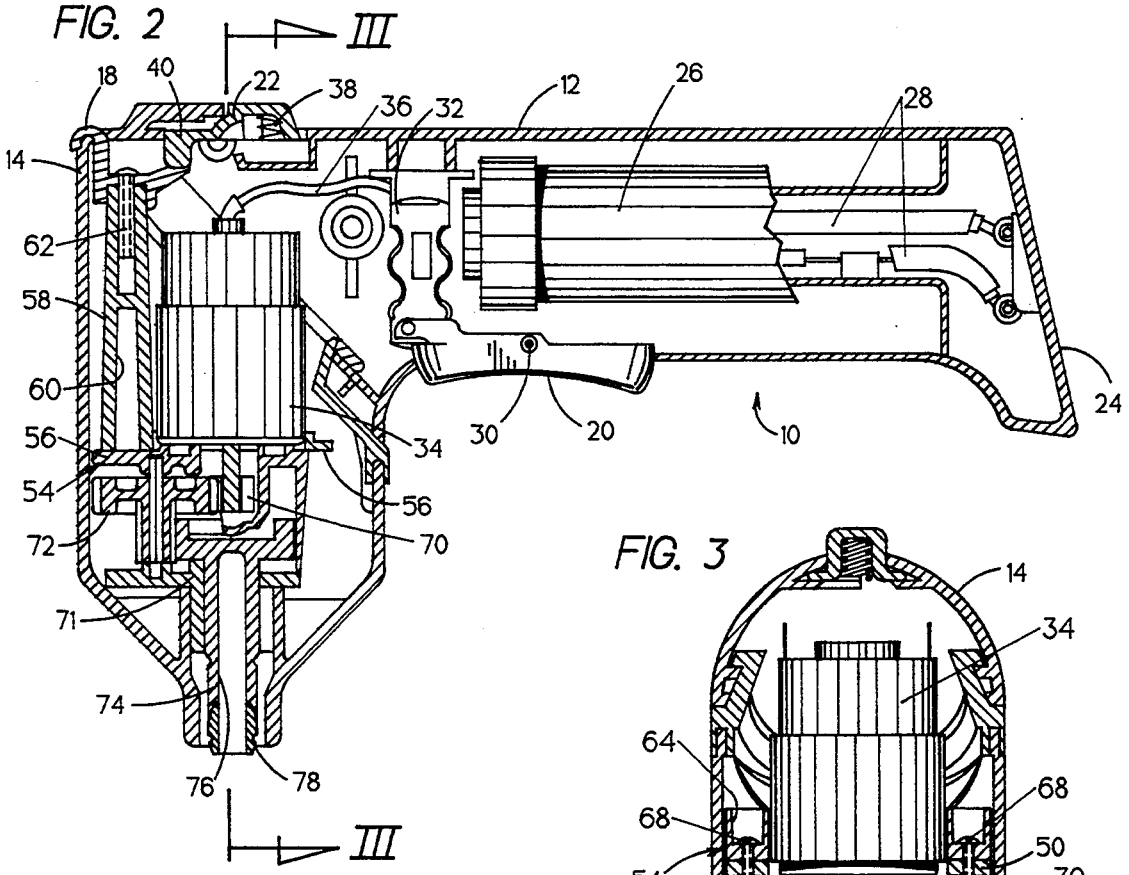
FIG. 2 is a longitudinal sectional view of the device illustrating the head in a second operating position.

Referring now to the drawing, there is disclosed a preferred embodiment of the present invention. In referring to the various figures of the drawing, like numerals shall refer to like parts.

Referring specifically to FIG. 1, there is disclosed a hand-held device 10 having a second housing member 12 and a first housing member 14. As shall be more fully explained hereinafter, housing member 14 is rotatable relative to housing member 12. In the position illustrated in FIG. 1, the longitudinal axes of housing members 12 and 14 are colinear and mixer 10 is in an operating position, which for sake of convenience, shall be described as the blending position.

Housing member 12 includes a pair of vertically spaced rivets 16 which form terminals for charging a rechargeable battery mounted within housing 12. Housing 14 has a seal member 18 connected thereto. Seal member 18 forms the junction or interface between housing members 12 and 14. An actuator 20 is used for activating device 10. Switch or latch button 22 is associated with a locking arm to be more fully described hereinafter for selectively locking housing member 12 in a selected operating position.

Referring now to FIGS. 2 through 6, a more detailed description of device 10 shall be provided. Housing 12 includes an end cap 24 which serves as an access door into the internal portion of the housing. Mounted within housing 12 is a battery pack comprised of a rechargeable nickel cadmium battery 26. Leads 28 connect the rechargeable battery to terminals 16. As is known to those skilled in the art, terminals 16 may be connected to a source of electrical energy for recharging battery 26 when required.

Actuator 20 is connected to housing 12 at pivot 30. Actuator 20 turns the device 10 on or off and is controlled by the user thereof. Actuator 20 in turn is connected to a slide switch 32 connected in series between battery pack 26 and motor 34. Suitable electrical conductors 36 connect motor 34 to battery pack 26 and switch 32. Latch button 22 extends through the upper face of housing 12 and includes a locking arm 40 which is retained in position via spring 38.

As particularly illustrated in FIG. 5, seal 18 has a circumferentially extending flange 42 disposed radially inward relative to the outer walls of housings 12 and 14. As illustrated, seal 18 is connected to housing 14. Flange 42 includes a pair of slots 44 spaced circumferentially 180° apart. Flange 42 also includes a stop member 46 spaced circumferentially 90° from each slot 44. As shall be more fully explained hereinafter, when housing 14 is in a first operating position relative to housing 12, locking arm 40 extends within a first one of the slots 44 and when housing 14 is in a second operating position relative to housing 12, the locking arm extends within the other of the slots 44.

As particularly illustrated in FIG. 4, housing 12 includes a circumferentially extending track 48 facing radially inward and designed to mate with flange 42 for enabling seal 18 and housing member 14 attached thereto to be rotated relative to housing 12. A pair of ribs 50 (only one of which is illustrated in FIG. 4) are formed in track 48 and are spaced circumferentially 180° apart. One of the ribs 50 engages stop member 46 on flange 42 to limit rotation of housing member 14 in a first direction and the other of the ribs 50 engages stop member 46 to limit rotation of the housing member in the other direction.

Motor 34 extends through an opening 52 formed by flange 42 and thereby extends beyond the pivot point for housing 12.

The end 55 of housing member 12 defining track 48 is formed at an angle. Likewise the end 57 of the housing 14 to which seal 18 is joined is also formed at an angle, the angled ends of housings 12 and 14 are complementary so that when housing 14 is in a first operating position it is coaxial with housing 12 and when in a second operating position it is basically at a 90° or right angle relative to housing 12. FIGS. 1 and 5 illustrate the coaxial position of housing 14 relative to housing 12 and FIGS. 2–4, and 6 illustrate the right angle position of housing 14 relative to housing 12.

A motor mount 54 connects motor 34 to seal 18 for rotation therewith. Motor mount 54 includes a first section 56 forming an annulus surrounding the motor and an axially extending column 58 having a bore 60 for receiving joining means such as screw 62. Seal 18 has an aperture which mates with bore 60 through which screw 62 is inserted for joining seal 18 to motor mount 54.

Figure 3:
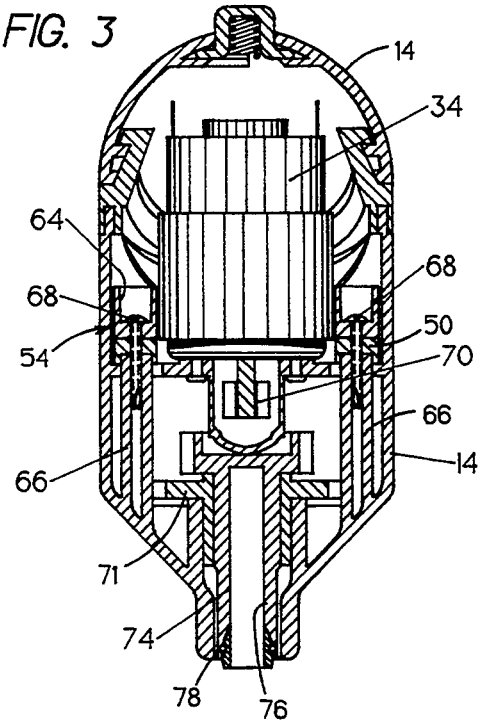
FIG. 3 is a sectional view taken along line III—III of FIG. 2.

As shown in FIG. 3, motor mount 54 also includes a pair of circumferentially spaced openings 64 which are axially aligned with axially extending columns 66 integrally connected to the inner face of the outer end of housing 14. Joining means such as screws 68 are inserted through openings 64 into columns 66 for connecting the motor mount to housing 14.

A pinion 70 is directly driven by motor 34. Pinion 70 is in driving engagement with an intermediate gear 72 which, in turn, is in driving engagement with an output gear 74 mounted within gear casing 71 which forms the second section of motor mount 54. Output gear 74 includes a bore 76 into which the particular accessory such as a beater, whisk, or the like can be inserted by the user. Springs 78 retain the accessory within bore 76.

When the user desires to use device 10 as a blender, housing 14 is positioned coaxial with housing 12 as illustrated in FIG. 1. Locking arm 40 of latch button 22 is disposed in one of the slots 44 formed in flange 42 to retain housing 14 in its coaxial position relative to housing 12. When the user desires to use device 10 as a mixer, housing 14 is rotated to the positions illustrated in FIGS. 2 and 6.

To enable the user to rotate housing 14 relative to housing 12, latch button 22 is pressed downwardly by the user to lift locking arm 40 from slot 44. This enables the user to rotate housing 14 relative to housing 12. Housing 14 can be rotated until rib 50 engages stop member 46 to prevent further rotation of the housing 14. Locking arm 40 is then inserted into the other of the slots 44 to lock the housing member in the mixer position illustrated in FIGS. 2 and 6. Ribs 50 and stop member 46 cooperate to limit rotation of housing 14 to insure that rotation of the housing relative to housing 12 does not result in twisting of electrical conductors 36. Housing 14 is rotated in a first direction to achieve its coaxial or blender operating position and is rotated in the other direction to achieve its 90° or mixer operating position.

As noted previously, motor 34 extends axially inwardly beyond the pivot for housing 14 relative to housing 12. Motor 34 extends from housing 14 through the doughnut-shaped opening 52 defined by flange 42 and into a portion of the space defined by housing 12. By extending the motor beyond the center of the pivot between the housings, a compact and stable design for the device can be achieved.

The present invention enables a user to effectively employ a single device as either a hand-held blender or a mixer. Interchangeable accessories such as beaters, whisks, and the like result in a very versatile product which provides the user with both the benefits of a mixer and the benefits of a blender in a single device.

While a preferred embodiment of the present invention is described and illustrated, the invention may be otherwise embodied within the scope of the following claims.

The invention claimed is:

1. A device comprising:

a housing including first and second housing members, said first housing member being selectively rotatable relative to said second housing member between first and second operating positions, the longitudinal axis of said first housing member being disposed at substantially 90° angle relative to the longitudinal axis of the second housing member when in said first operating position and being disposed substantially coaxial with the longitudinal axis of said second housing member when in said second operating position;

switch means including locking means selectively engagable with said first housing member for locking said first housing member in its selected operating position when in engagement therewith; and one of said housing members includes a seal having a circumferentially extending flange disposed radially inward relative to an outer wall of said one member and the other of said housing members includes a circumferentially extending track, said track mating with said flange for enabling said first housing member to be rotated relative to said second housing member.

2. A device according to claim 1 wherein said seal is mounted on said first housing member and said flange includes a pair of notches circumferentially spaced 180° apart, with the locking means being selectively engagable with one of said notches to lock said first housing member in said first operating position and being selectively engagable with the other of said notches to lock said first housing member in said second operating position.

3. A device according to claim 2 wherein said flange includes a first stop member and said track includes a pair of ribs spaced circumferentially 180° apart, with engagement of said first stop member with a first one of said ribs preventing further rotation of said first housing member in a first direction and engagement of said stop member with the other of said ribs preventing further rotation of said first housing member in a second direction.

4. A device according to claim 1 including a removable battery pack within said second housing member.

5. A device according to claim 4 wherein the first housing member has a motor mounted therewithin electrically connected to said battery pack.

6. A device according to claim 5 wherein the first housing member includes a motor mount connected to said seal, said motor being connected to said mount such that the longitudinal axis of the motor extends inwardly into a space defined by the second housing member and through an opening defined by an inner wall of the flange.

7. A device comprising:

a housing including first and second housing members, said first housing member including a seal having a doughnut-shaped flange disposed radially inward relative to an outer wall of said first housing member, said first housing member being selectively rotatable relative to said second housing member between first and second operating positions, the longitudinal axis of said first housing member being disposed at a substantially 90° angle relative to the longitudinal axis of the second housing member when in said first operating position and being disposed substantially coaxial with the longitudinal axis of the second housing member when in said second operating position, said seal forming a transition member between said first and second housing members, said second housing member having a circumferentially extending track mating with said flange for enabling said first housing member to be rotated relative to said second housing member; and switch means including locking means selectively engagable with the first housing member for retaining the first housing member in its selected operating position when in engagement therewith.

8. A device according to claim 7 wherein said flange includes a pair of notches circumferentially spaced 180° apart, with the locking means being selectively engagable with one of said notches to lock said first housing member in said first operating position and being selectively engagable with the other of said notches to lock said first housing member in said second operating position.

9. A device according to claim 8 wherein said first housing member includes a motor mount for mounting a motor in said first housing member, the longitudinal axis of the motor extending inwardly through the doughnut shaped flange of said seal into a space defined by said second housing member.

* * * * *